United States Patent [19]

Baker

[11] Patent Number: 4,580,659

[45] Date of Patent: Apr. 8, 1986

[54] COMBINATION FIRE ESCAPE TUBE AND RESCUE VEHICLE

[75] Inventor: Ralph T. Baker, New Castle, Del.

[73] Assignee: Baker Safety Equipment, Inc., New Castle, Del.

[21] Appl. No.: 750,073

[22] Filed: Jun. 27, 1985

[51] Int. Cl.[4] ..... A62B 1/20

[52] U.S. Cl. ..... 182/48; 193/25 R; 182/2

[58] Field of Search ..... 182/48, 49, 47, 129, 182/2; 193/25 R

[56] References Cited

U.S. PATENT DOCUMENTS

| | | | |
|---|---|---|---|
| 318,299 | 5/1885 | Samper | 182/48 |
| 775,158 | 11/1904 | Wenig | 182/48 |
| 3,088,542 | 5/1963 | Johnson | 182/48 |
| 3,301,347 | 1/1967 | Saita | 182/48 |
| 3,580,358 | 5/1971 | Yamamoto | 182/48 |
| 4,099,595 | 7/1978 | Tracy | 182/48 |
| 4,099,596 | 7/1978 | Tracy | 182/48 |
| 4,398,621 | 8/1983 | Baker | 182/48 |

FOREIGN PATENT DOCUMENTS

| | | | |
|---|---|---|---|
| 482446 | 1/1970 | Switzerland | 182/48 |
| 1308367 | 2/1973 | United Kingdom | 182/48 |

*Primary Examiner*—Reinaldo P. Machado
*Attorney, Agent, or Firm*—Mortenson & Uebler

[57] ABSTRACT

A combination fire escape tube and rescue vehicle is provided. The fire escape comprises an upper, supporting entry ring member and a mesh tube attached to this upper support member, the mesh tube being substantially longer than the building height from which escape is necessary, and a lower, exit-opening support ring member attached to the lower end of the mesh tube. The rescue vehicle has boom-like, height-adjustable apparatus, to the upper end of which is affixed a universal joint to which the supporting entry ring member is attached, thereby providing for flush alignment of the entry ring member against the wall of the building at a window or other opening at a desired height, regardless of the angle of approach of the boom to the building. The lower exit-opening support ring member can be adjustably attached to the mesh tube near the ground by ground support personnel. In the event of a fire in a building, the rescue vehicle equipped with the fire escape tube according to the invention can be used entirely externally of said building to permit persons to escape, and is limited only by the height to which the boom can reach.

12 Claims, 8 Drawing Figures

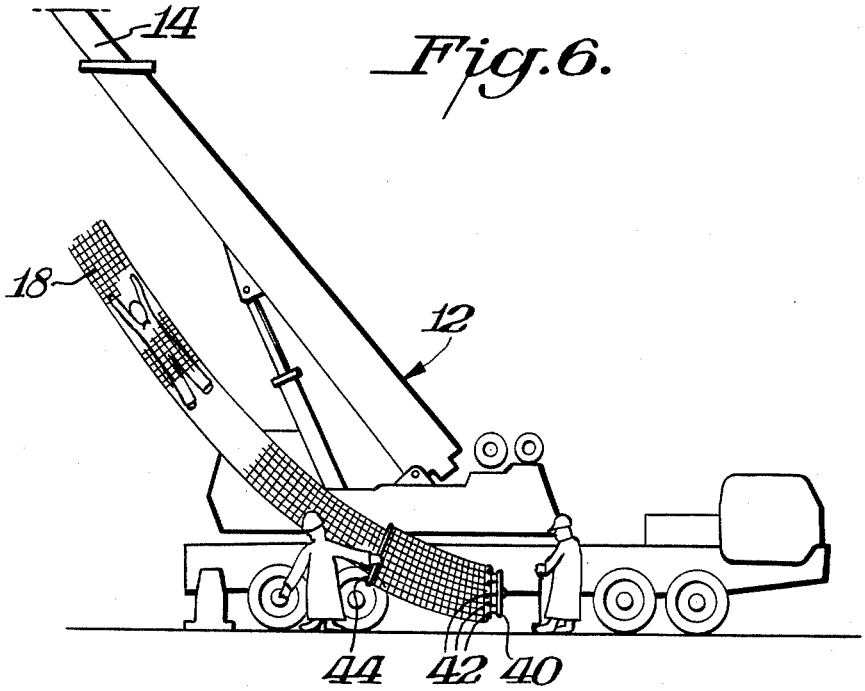
Fig. 6.
Fig. 7.
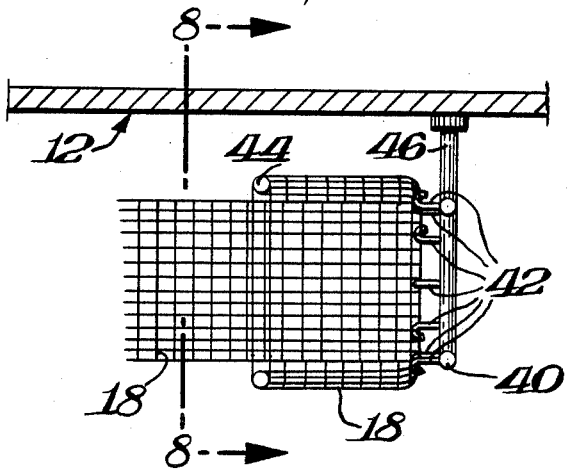
Fig. 8.
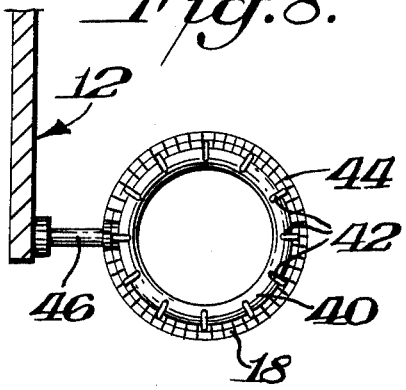

COMBINATION FIRE ESCAPE TUBE AND RESCUE VEHICLE

BACKGROUND OF THE INVENTION

This invention relates generally to fire escapes for an individual's use in evacuating a multiple story building.

Conventional fire escapes have disadvantages. They are generally finite in number, e.g. one or two per floor in a given building, if provided at all, and fixed in place so that, if smoke and flame approach a lower part of such fire escape, it is useless to persons on floors above that lower part.

As was apparent in the fires at the MGM Grand Hotel in 1980 and the Las Vegas Hilton hotel in 1981, present modern fire escapes are inadequate. In the MGM fire, at least 84 persons died. In the Hilton fire, 8 persons died. In both, helicopters having rescue seats suspended by cables from the aircraft were used to rescue persons from the roofs of the buildings and, in some instances, from balconies and windows. While these rescue efforts saved some lives, this method is very time consuming and terrifying to the inexperienced person being rescued.

More recently, 79 people died in a hospital fire in Bueno Aires, Argentina, because, as is typical in Argentina, the building was not equipped with fire escapes.

Many prior art devices are known which relate to chutes or tubes for use in escaping high-rise buildings in the event of a fire. Exemplary of such devices are those shown in U.S. Pat. Nos. 4,240,520 (1980) and 4,099,596 (1978).

U.S. Pat. No. 4,240,520 discloses a fire escape tunnel for use in exiting high-rise buildings. The tunnel includes an extendable, accordian-pleated tubing made of nylon or canvas fabric padded on its inner side, a ring at its upper end attachable to an escape opening of a building, a lower end of the tubing having a soft landing pad, and an exit doorway so a person sliding or being lowered down the tunnel can step out onto the ground at the exit.

U.S. Pat. No. 4,099,596 discloses a device including a normally-folded flexible tube with a landing pad at its lower end that unfolds to a vertical chute condition, the interior of the tube being slippery to provide against snagging and the like, the unfolded tube being formed with elastic restrictions at successive vertical levels that snub the descent of a person descending inside from free fall to an alleged safe speed.

U.S. Pat. No. 3,580,358 discloses a safety escape chute having a series of pliant tubular columns connected by resilient portions made of spiral mesh so that when a first escaper is in the chute his weight so deforms the spiral mesh resilient portions downwardly that a second escaper cannot pass therethrough and thus cannot collide with the first escaper at the bottom of the chute.

The fire escape tube utilized in this invention is basically as described and claimed in may prior U.S. Pat. No. 4,398,621, and that disclosure is incorporated herein by reference.

Tubular fire escapes used together with "cherry pickers" are known such as, for example, the apparatus described in U.S. Pat. No. 4,099,595.

The present invention overcomes many disadvantages inherent in prior art apparatus.

SUMMARY OF THE INVENTION

A combination fire escape tube and rescue vehicle apparatus is provided which provides entirely external means for exiting a building through an opening in the building. The apparatus comprises an upper, supporting entry ring member and a mesh tube attached at its upper end to the upper supporting entry ring member, the mesh tube being substantially longer than the building height from which escape is necessary, and a lower, exit-opening support ring member attached to the lower end of the mesh tube, the rescue vehicle having boom-like, height-adjustable apparatus extending from the vehicle to an upper end, the upper end having an upper control assembly affixed thereat, and a universal joint assembly attached to the upper control assembly to which is attached the upper, supporting entry ring member, thereby providing for flush alignment of the entry ring member against a wall of the building at a window or other opening in the building at a desired height, regardless of the angle of approach of the boom-like apparatus to the building, the lower exit-opening support ring member preferably being adjustably attached to the rescue vehicle near the ground, whereby in the event of a fire in the building, the rescue vehicle equipped with this fire escape tube can be used entirely externally of the building to permit persons to escape from openings in the building reachable by the upper end of the boom-like apparatus. The universal joint assembly preferably comprises a rigid support arm affixed to the control assembly and extends substantially horizontally therefrom to an end, at which end is provided a swivel joint which swivels about a vertical axis, the swivel joint being attached to a substantially horizontal swivel arm having a substantially vertical support arm affixed at each end thereof, each vertical support arm having affixed at its lower end a swivel joint which swivels about a horizontal axis, the horizontal swivel joints being affixed to the entry support ring at each end of a diameter thereof. The lower exit-opening support ring member preferably has hooks affixed thereto about its periphery for grasping the mesh tube, the ring being rigidly affixed to the rescue vehicle by bracket means, the mesh tube being adjustable lengthwise by adjusting the lengthwise position of the tube at which the hooks grasp the tube, and an outer selvage ring attached to the end of the tube which provides means to pull any excess length of the tube away from the exit-opening of the chute. The exit-opening support ring preferably has a diameter of about 3 feet and the selvage ring preferably has a diameter of about 4 feet. A generally semicircular spacer bar is preferably attached to the upper support ring and intertwined among the meshes of the mesh tube in such orientation that the spacer bar is oriented at approximately 45° to the vertical, thereby providing an easily accessible entrance opening for the user. The openings in the mesh tube are large enough to permit finger insertion therein but small enough to prevent foot insertion therethrough, preferably having a maximum dimension of about two inches. The tube has inside diameter sufficiently large so as not to restrict passage of a person escaping therethrough, whereby the escaping person can control his rate of descent by grasping the mesh anywhere within the tube, the tube preferably having an inside diameter in the range of about 3 feet to about 4 feet. The mesh tube is preferably made of fire resistant nylon cord or fire resistant, elastic bungi cord.

BRIEF DESCRIPTION OF THE DRAWINGS

FIG. 6 is a schematic view of the lower portion of the apparatus of the invention showing a person lowering himself to safety through the fire escape chute according to the invention.

FIG. 7 is a top plan view of a lower portion of the apparatus according to the invention wherein the mesh fire escape tube is preferably affixed to the lower exit-opening support ring by means of hooks, with excess chute being pulled back over itself by means of a selvage ring, the lower support ring being rigidly affixed to the rescue vehicle.

FIG. 8 is a cross-sectional view of the assembly taken along line 8—8 of FIG. 7.

DETAILED DESCRIPTION OF THE INVENTION AND PREFERRED EMBODIMENTS WITH REFERENCE TO THE DRAWINGS

A combination fire escape tube and rescue vehicle is provided. The fire escape comprises an upper, supporting entry ring member and a mesh tube attached to this upper support member, the mesh tube being substantially longer than the building height from which escape is necessary, and a lower, exit-opening support ring member attached to the lower end of the mesh tube. The rescue vehicle has boom-like, height-adjustable apparatus, to the upper end of which is affixed a universal joint to which the supporting entry ring member is attached, thereby providing for flush alignment of the entry ring member against the wall of the building at a window or other opening at a desired height, regardless of the angle of approach of the boom to the building. The lower exit-opening support ring member can be adjustably attached to the mesh tube near the ground by ground support personnel. In the event of a fire in a building, the rescue vehicle equipped with the fire escape tube according to the invention can be used entirely externally of said building to permit persons to escape, and is limited only by the height to which the boom can reach.

Figure 1:
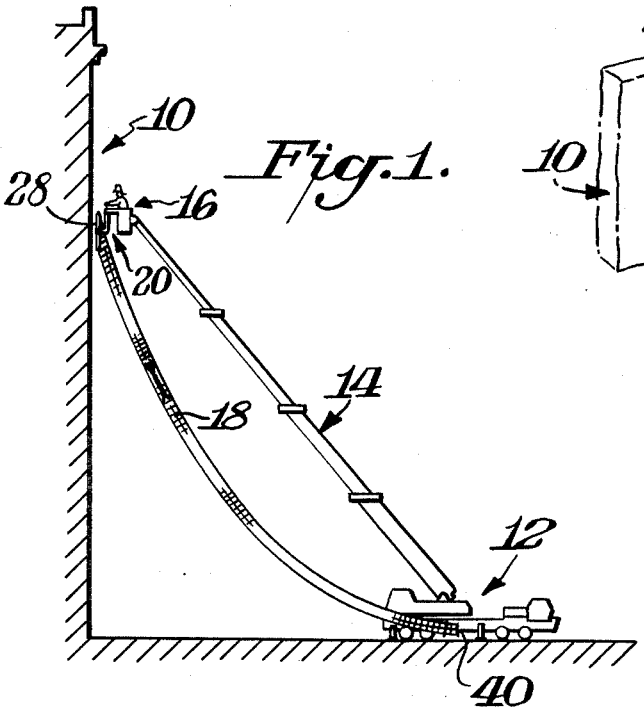
FIG. 1 is a schematic view of the combination fire escape tube and rescue vehicle according to the invention wherein the entry to the fire escape chute is being raised to a desired opening such as a window in a building.

The detailed description of the invention and preferred embodiments is best provided with reference to the accompanying drawings wherein FIG. 1 is a schematic view of the escape apparatus being raised into position against a building. Rescue vehicle 12 is equipped with telescoping, preferably hydraulically actuated "boom" means 14, at the upper end of which is the upper control assembly 16 to which is attached universal joint assembly 20. The universal joint assembly 20 holds the upper entry support ring 28 to which is attached mesh tube 18 which extends from the upper support ring 28 downwardly to vehicle 12 where it is attached to lower exit-opening support ring 40. Ring 40 is preferably attached to vehicle 12 as shown. A person is shown schematically descending through escape tube 18 from building 10.

Figure 2:
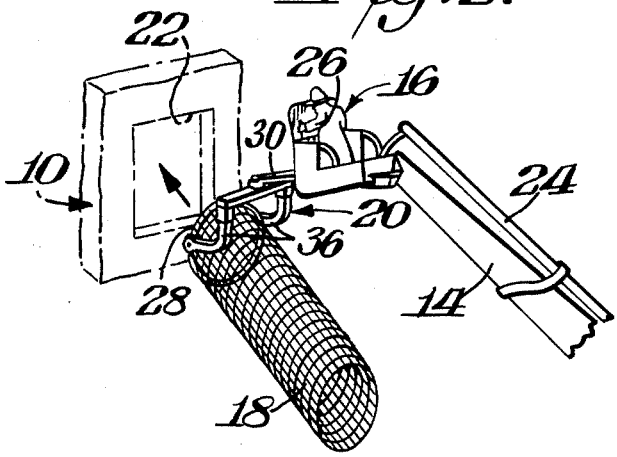
FIG. 2 is a schematic view of the upper end of the fire escape chute being maneuvered into position by an emergency service person in a control "bucket" at the upper end of the boom of the emergency service vehicle according to the invention.

FIG. 2 shows in some schematic detail the upper portion of boom 14, upper control assembly 16, and universal joint 20 holding the upper end of the escape chute and entry opening support ring 28 approaching window 22 of building 10, as depicted by the arrow. The operator 26 controls the movement of upper control assembly, or "bucket", 16 by known means. He optionally may have water supply means 24 for use in extinguishing a fire. By positioning the upper end of boom 14 so that the upper entry ring 28 is adjacent a desired window or other opening 22 in building 10, the universal joint assembly keeps the entry ring 28 flush against and adjacent to the opening 22 regardless of the angle of approach of the boom 14 to the building 10.

Figure 5:
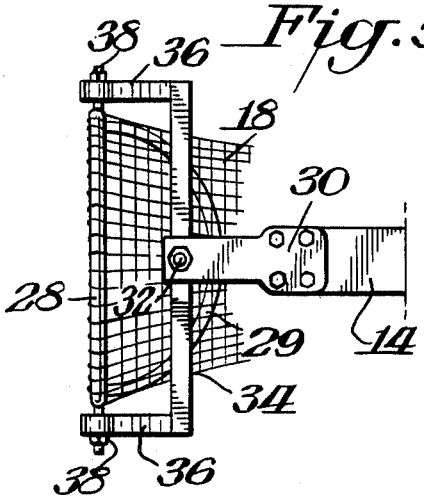
FIG. 4 is a front elevation of said universal joint assembly and FIG. 5 is a top plan view of said assembly.
Figure 4:
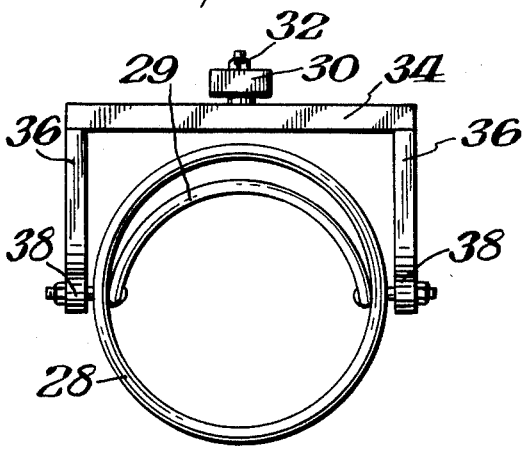
Figure 3:
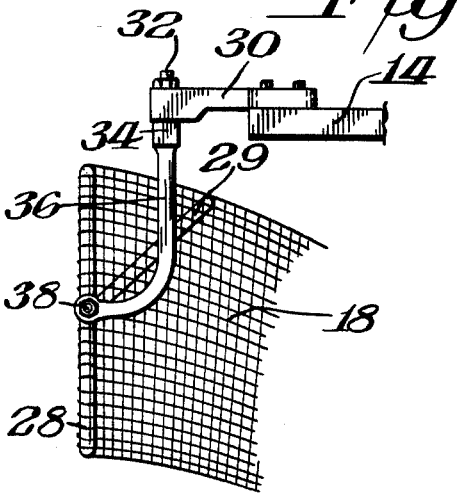
FIG. 3 is a side elevational view of the universal joint assembly attached to the entry ring member of the fire escape chute which enables the entry ring to be placed flush against a building regardless of the angle of approach of the boom to the building.

FIGS. 3–5 show, respectively, side elevation, front elevation and top plan views of a preferred universal joint assembly for use in connection with the invention. Horizontal support arm 30 extends substantially horizontally from boom 14, shown in phantom. At the outer end of support arm 30 is swivel joint 32, which swivels about a substantially vertical axis. Attached to swivel joint 32 is horizontal support arm 34, at each end of which is attached a vertical support arm 36. At the lower end of each vertical support arm are swivel joints 38 which swivel about a substantially horizontal swivel axis. Attached to the swivel joints is entry support ring member 28, attached at each end of a diameter thereof. Preferably, semi-circular spacer bar 29 is pivotally attached between the swivel joints 38 and the entry ring 28 as shown, and is intertwined among the mesh of tube 18 so as to be oriented at an approximate 45° to the vertical orientation of ring 28, so as to provide a ready access opening to escape tube 18.

FIG. 6 shows the lower end of the apparatus of this invention and a person descending to the ground through tube 18. Boom 14 extends upwardly from vehicle 12. Ground personnel are shown who are available for assisting persons to exit through exit support ring 40, which is preferably about 3 feet in diameter. The meshes of tube 18 are held in place and are lengthwise adjustably anchored by hooks 42 attached to the periphery of ring 40. External, lightweight selvage ring 44 is attached to the end of tube 18 and is used to pull excess netting away from the exit 40 of the chute. Ring 44 is preferably of lightweight aluminum and is about 4 feet in diameter.

FIG. 7 shows a top plan view of mesh tube 18 attached by means of hooks 42 attached to exit-opening support ring 40, the ring 40 being affixed to vehicle 12 by means of bracket 46. Selvage ring 44 is shown pulling excess mesh tube 18 back over itself and out of the way.

FIG. 8 shows a cross-sectional view taken along line 8—8 of FIG. 7 and shows mesh tube 18 held by hooks 42 to ring 40, the latter held to vehicle 12 by bracket 46. Selvage ring 44 is shown in perspective.

Materials of construction will be apparent to one skilled in the art. Preferably, the supporting members and univeral joint are of structural steel and the mesh tube is of fire resistant nylon cord.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. A combination fire escape tube and rescue vehicle apparatus is provided which provides entirely external means for exiting a building through an opening in said building, the apparatus comprising an upper, supporting entry ring member and a mesh tube attached at its upper end to said upper supporting entry ring member, said mesh tube being substantially longer than the building height from which escape is necessary, and a lower, exit-opening support ring member attached to the lower end of said mesh tube, said rescue vehicle having boom-like, height-adjustable apparatus extending from said vehicle to an upper end, said upper end having an upper control assembly affixed thereat, and a universal joint assembly attached to said upper control assembly to which is attached said upper, supporting entry ring member, thereby providing for flush alignment of said entry ring member against a wall of said building at a window or other opening in said building at a desired height, regardless of the angle of approach of said boom-like apparatus to said building, said lower exit-opening support ring member being positioned near the ground, whereby, in the event of a fire in said building, said rescue vehicle equipped with said fire escape tube can be used entirely externally of said building to permit persons to escape from openings in said building reachable by said upper end of said boom-like apparatus.

2. The apparatus of claim 1 wherein said universal joint assembly comprises a rigid support arm affixed to said control assembly and extending substantially horizontally therefrom to an end, at which end is provided a swivel joint which swivels about a vertical axis, the swivel joint being attached to a substantially horizontal swivel arm having a substantially vertical support arm affixed at each end thereof, each vertical support arm having affixed at its lower end a swivel joint which swivels about a horizontal axis, said horizontal swivel joints being affixed to said entry support ring at each end of a diameter thereof.

3. The apparatus of claim 1 wherein said lower exit-opening support ring member has hooks affixed thereto about its periphery for grasping said mesh tube, said ring being rigidly affixed to said rescue vehicle by bracket means, said mesh tube being adjustable lengthwise by adjusting the lengthwise position of said tube at which said hooks grasp said tube, and an outer selvage ring attached to the end of said tube which provides means to pull any excess length of said tube away from the exit-opening of said chute.

4. The apparatus of claim 3 wherein said exit-opening support ring has a diameter of about 3 feet.

5. The apparatus of claim 3 wherein said selvage ring has a diameter of about 4 feet.

6. The apparatus of claim 1 having a generally semicircular spacer bar attached to said upper support ring and intertwined among the meshes of said mesh tube in such orientation that said spacer bar is oriented at approximately 45° to the vertical, thereby providing an easily accessible entrance opening for said user.

7. The apparatus of claim 1 wherein the openings in said mesh tube are large enough to permit finger insertion therein but small enough to prevent foot insertion therethrough.

8. The apparatus of claim 1 wherein the openings in said mesh tube have a maximum dimension of about two inches.

9. The apparatus of claim 1 wherein said tube has inside diameter sufficiently large so as not to restrict passage of a person escaping therethrough, whereby said escaping person can control his rate of descent by grasping the mesh anywhere within the tube.

10. The apparatus of claim 1 wherein said mesh tube has an inside diameter in the range of about 3 feet to about 4 feet.

11. The apparatus of claim 1 wherein said mesh tube is made of fire resistant nylon cord.

12. The apparatus of claim 1 wherein said mesh tube is made of fire resistant, elastic bungi cord.

* * * * *